US007242003B2

(12) United States Patent
Wagenaar et al.

(10) Patent No.: US 7,242,003 B2
(45) Date of Patent: Jul. 10, 2007

(54) INVERSE COLLIMATION FOR NUCLEAR MEDICINE IMAGING

(75) Inventors: Douglas Jay Wagenaar, South Barrington, IL (US); Jinhun Joung, Algunquin, IL (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 38 days.

(21) Appl. No.: 11/234,976

(22) Filed: Sep. 26, 2005

(65) Prior Publication Data

US 2006/0091313 A1 May 4, 2006

(51) Int. Cl.
*G21K 1/02* (2006.01)

(52) U.S. Cl. ..... 250/363.1

(58) Field of Classification Search ..... 250/363.1, 250/363.02, 363.01; 378/147, 145, 157, 378/158

See application file for complete search history.

(56) References Cited

U.S. PATENT DOCUMENTS 5,773,829 A * 6/1998 Iwanczyk et al. ..... 250/367
6,370,228 B1 * 4/2002 Mockler et al. ..... 378/158

* cited by examiner

*Primary Examiner*—David Porta
*Assistant Examiner*—Marcus Taningco

(57) ABSTRACT

An inverse collimator detector for nuclear medicine imaging applications is provided. The inverse collimator detector includes an inverse collimator wherein high density, high atomic number collimator material is placed in the location where the conventional collimator has no material, and no material is placed where the conventional collimator has high density, high atomic number collimator material. The inverse collimator detector of the present invention allows significantly higher detection efficiency for incident photons while providing distance information and maintaining high resolution for isolated, small sources of radioactivity associated with molecular imaging agents.

10 Claims, 5 Drawing Sheets

INVERSE COLLIMATION FOR NUCLEAR MEDICINE IMAGING

BACKGROUND OF THE INVENTION

1. Field of the Invention

The present invention generally relates to nuclear medicine, and systems for obtaining nuclear medical images of a patient's body organs of interest. In particular, the present invention relates to a novel detector configuration for single photon imaging including single photon emission computed tomography (SPECT) and planar imaging.

2. Description of the Background Art

Nuclear medicine is a unique medical specialty wherein radiation is used to acquire images that show the function and anatomy of organs, bones or tissues of the body. Radiopharmaceuticals are introduced into the body, either by injection or ingestion, and are attracted to specific organs, bones or tissues of interest. Such radiopharmaceuticals produce gamma photon emissions that emanate from the body. One or more detectors are used to detect the emitted gamma photons, and the information collected from the detector(s) is processed to calculate the position of origin of the emitted photon from the source (i.e., the body organ or tissue under study). The accumulation of a large number of emitted gamma positions allows an image of the organ or tissue under study to be displayed.

Single photon imaging, either planar or SPECT, relies on the use of a collimator placed between the source and a scintillation crystal or solid state detector, to allow only gamma rays aligned with the holes of the collimator to pass through to the detector, thus inferring the line on which the gamma emission is assumed to have occurred. Single photon imaging techniques require gamma ray detectors that calculate and store both the position of the detected gamma ray and its energy.

Two principal types of collimators have been used in nuclear medical imaging. The predominant type of collimation is the parallel-hole collimator. This type of collimator contains hundreds of parallel holes drilled or etched into a very dense material such as lead. The parallel-hole collimator accepts only photons traveling perpendicular to the scintillator surface, and produces a planar image of the same size as the source object. In general, the resolution of the parallel-hole collimator increases as the holes are made smaller in diameter and longer in length. The parallel-hole collimator offers greater sensitivity than a pinhole collimator, and its sensitivity does not depend on how closely centered the object is to the detector.

The conventional pinhole collimator typically is cone-shaped and has a single small hole drilled in the center of the collimator material. The pinhole collimator generates a magnified image of an object in accordance with its acceptance angle, and is primarily used in studying small organs such as the thyroid or localized objects such as a joint. The pinhole collimator must be placed at a very small distance from the object being imaged in order to achieve acceptable image quality. The pinhole collimator offers the benefit of high magnification of a single object, but loses resolution and sensitivity as the field of view (FOV) gets wider and the object is farther away from the pinhole.

Other known types of collimators include converging and diverging collimators. The converging collimator has holes that are not parallel; rather, the holes are focused toward the organ with the focal point being located in the center of the FOV. The image appears larger at the face of the scintillator using a converging collimator. The converging collimator has a lower sensitivity than the parallel-hole collimator, especially with thick objects.

The diverging collimator results by reversing the direction of the converging collimator. The diverging collimator is typically used to enlarge the FOV, such as would be necessary with a portable camera having a small scintillator. The diverging collimator has a lower sensitivity than the parallel-hole collimator, especially with thick objects.

The ability to image "hot spots" (i.e., small, isolated intense sources of radioactivity) has become an important imaging task in nuclear medicine. Conventional collimated nuclear medicine imaging is not designed to image small, isolated volumes of radioactivity with high resolution or in an efficient manner. It is merely intended to allow CT-like accumulation of planar or projection image data for reconstruction of large body volumes, such as the torso or the pelvis. This imaging task limits the acquisition techniques in nuclear medicine to the parallel-hole and, with corrections for distortions, converging collimation. Consequently, the choice of collimation represents a trade-off between the size of the FOV and the sensitivity and spatial resolution required to properly visualize the target object or organ. Thus, there exists a need in the art for improvements in collimator technology to enhance the imaging of small, isolated intense sources of radioactivity through improved detection efficiency and spatial information.

SUMMARY OF THE INVENTION

The present invention solves the existing need by providing a new collimator geometry that enhances the imaging of small, isolated intense sources of radioactivity with high resolution or in an efficient manner.

According to one preferred embodiment of the present invention, an inverse collimator detector for detecting isolated, small sources of radiation is provided. The inverse collimator detector includes a scintillator that interacts with radiation emanating from a target object being imaged, and an inverse collimator having a plurality of collimation holes filled with collimation rods and a plurality of openings formed between the filled collimation holes. The inverse collimator is provided between the target object and the scintillator. Also, one or more photosensors are optically coupled to the scintillator to receive interaction events from the scintillator.

According to another embodiment of the present intention, an inverse collimator is provided. The inverse collimator includes an array of collimation holes providing a path for perpendicularly incident photons, and a plurality of openings formed between the collimation holes. Also, a plurality of collimation rods are disposed within the collimation holes. The collimation rods have a diameter corresponding to the diameter of the collimation holes and a length corresponding to the depth of the collimation holes. The length of the collimation rods determines the sensitivity of the inverse collimator.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements. A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
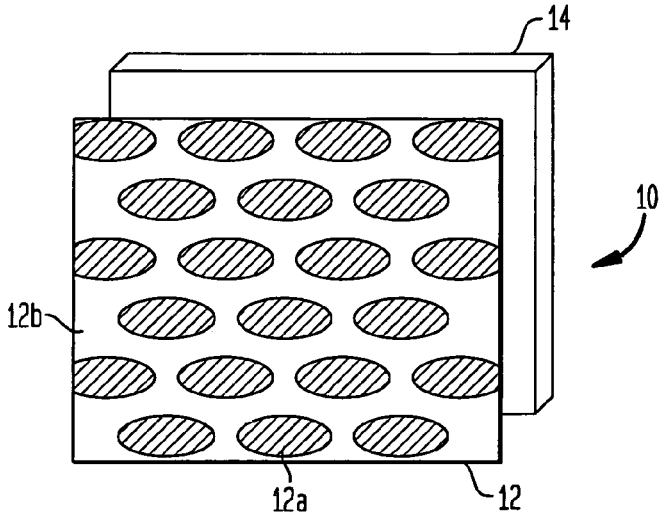
FIG. 1 is a perspective view of an inverse collimator detector according to an exemplary embodiment of the present invention.

FIG. 1 is a perspective view of an inverse collimator detector 10 according to an exemplary embodiment of the present invention. Referring to FIG. 1, the inverse collimator detector 10 includes an inverse collimator 12 spaced apart from a scintillator 14. The inverse collimator detector 10 uses the inverse collimator 12 and the scintillator 14 to resolve images of small, isolated sources of radioactivity associated with molecular imaging agents.

The scintillator 14 absorbs the photons that pass through the inverse collimator 12, and converts the energy into light. The scintillator 14 can be either organic or inorganic. In the preferred embodiment, the scintillator 14 is an inorganic crystal scintillator, such as CsI, as it is capable of detecting low energy gamma-rays. The scintillator 14 can be optically coupled to one or more photosensors (not shown), which convert the incoming light pulses into an amplified electronic signal.

The inverse collimator 12 can be a plastic member or the like having an array of collimation holes 12*a* with openings 12*b* formed between the collimation holes 12*a*. The inverse collimator 12 is approximately 120 mm in diameter having a thickness of approximately 5 mm.

Figure 4:
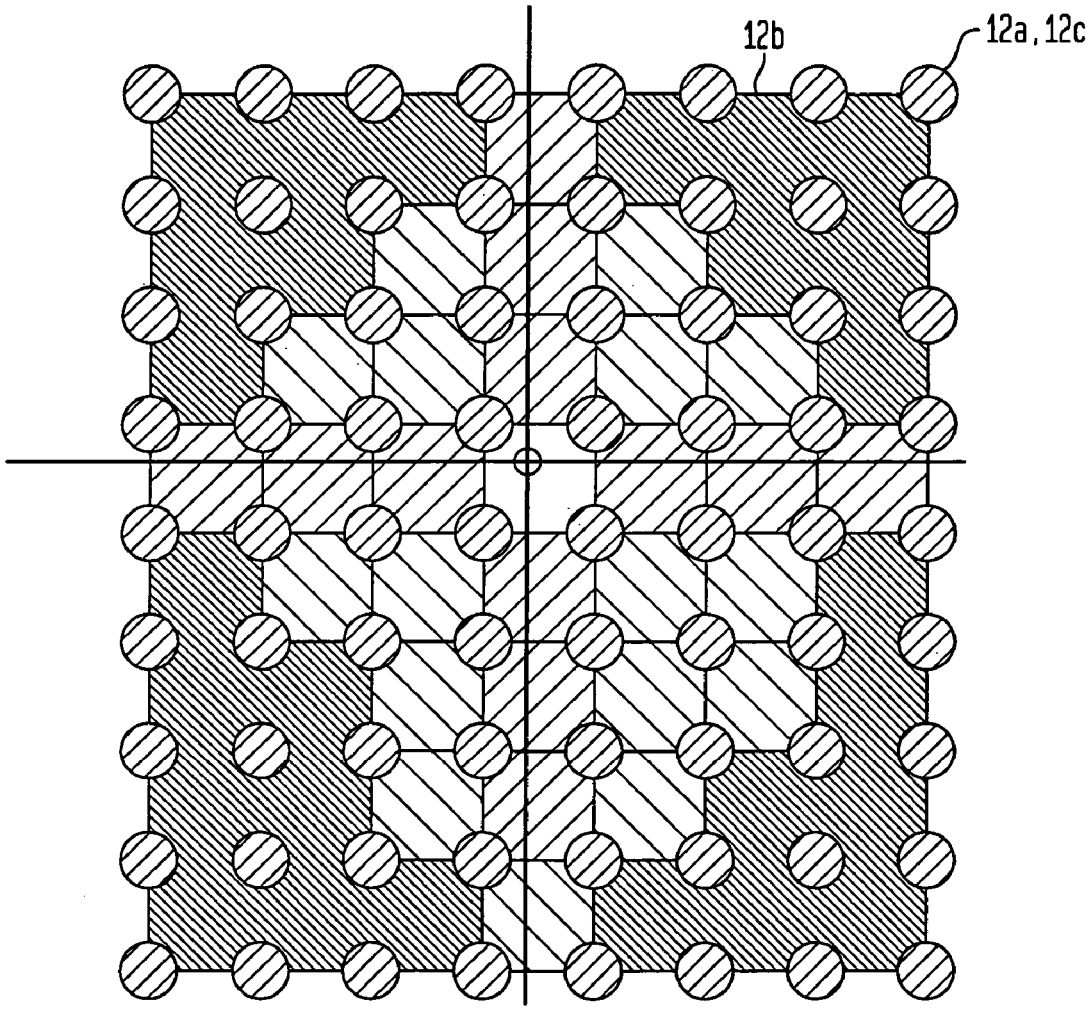
FIG. 4 shows an inverse collimator in a square array (with no septa)
Figure 5:
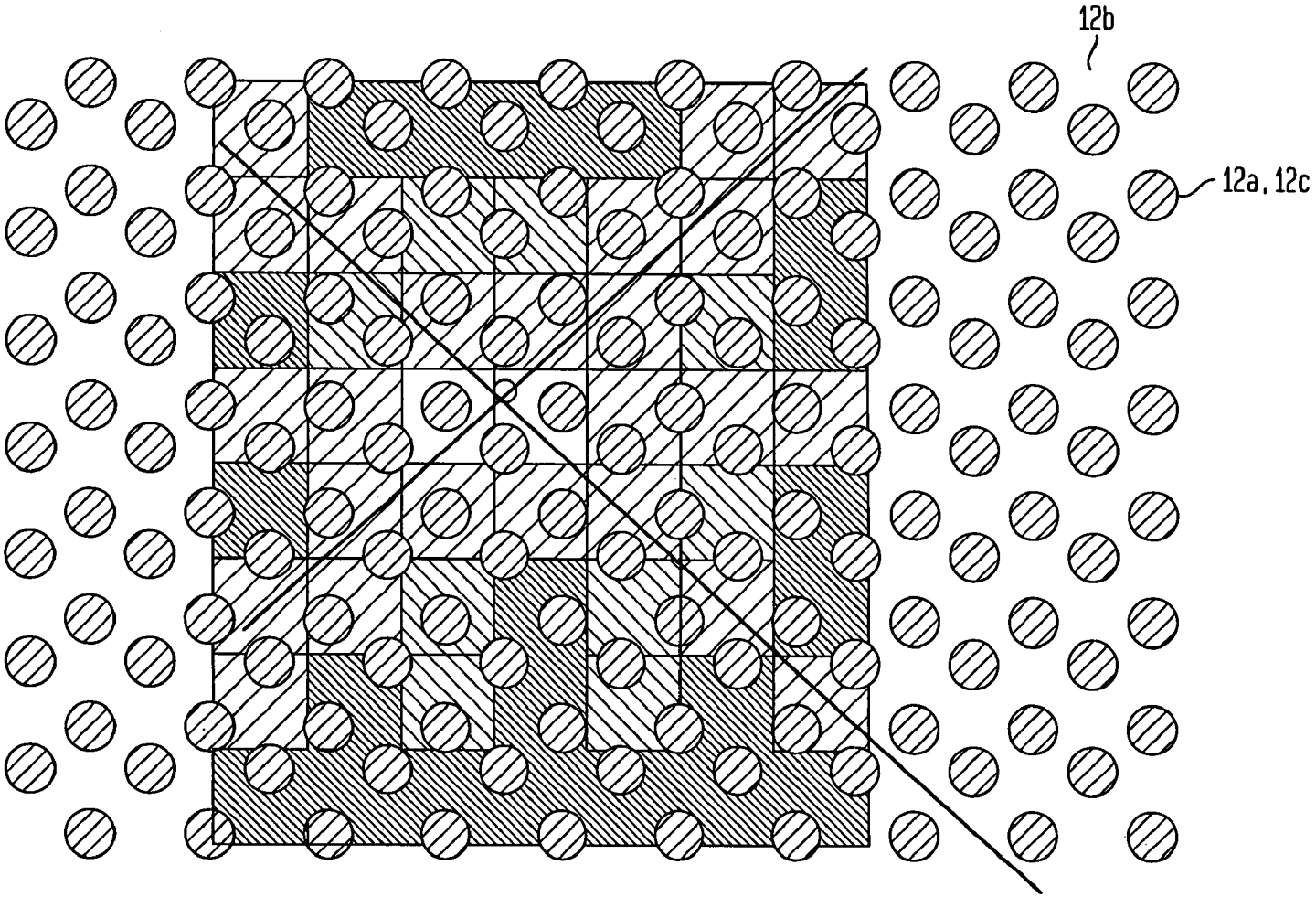
FIG. 5 shows an inverse collimator in a hexagonal square array.

The collimation holes 12*a* can have a circular, square, hexagonal, oval or other cross-sectional shape. In the preferred embodiment, the collimation holes 12*a* have a circular cross-sectional shape. The collimation holes 12*a* are approximately 0.2 to 1.0 mm, and can be arranged in a square array (FIG. 4), hexagonal array (FIG. 5), or the like.

Figure 2:
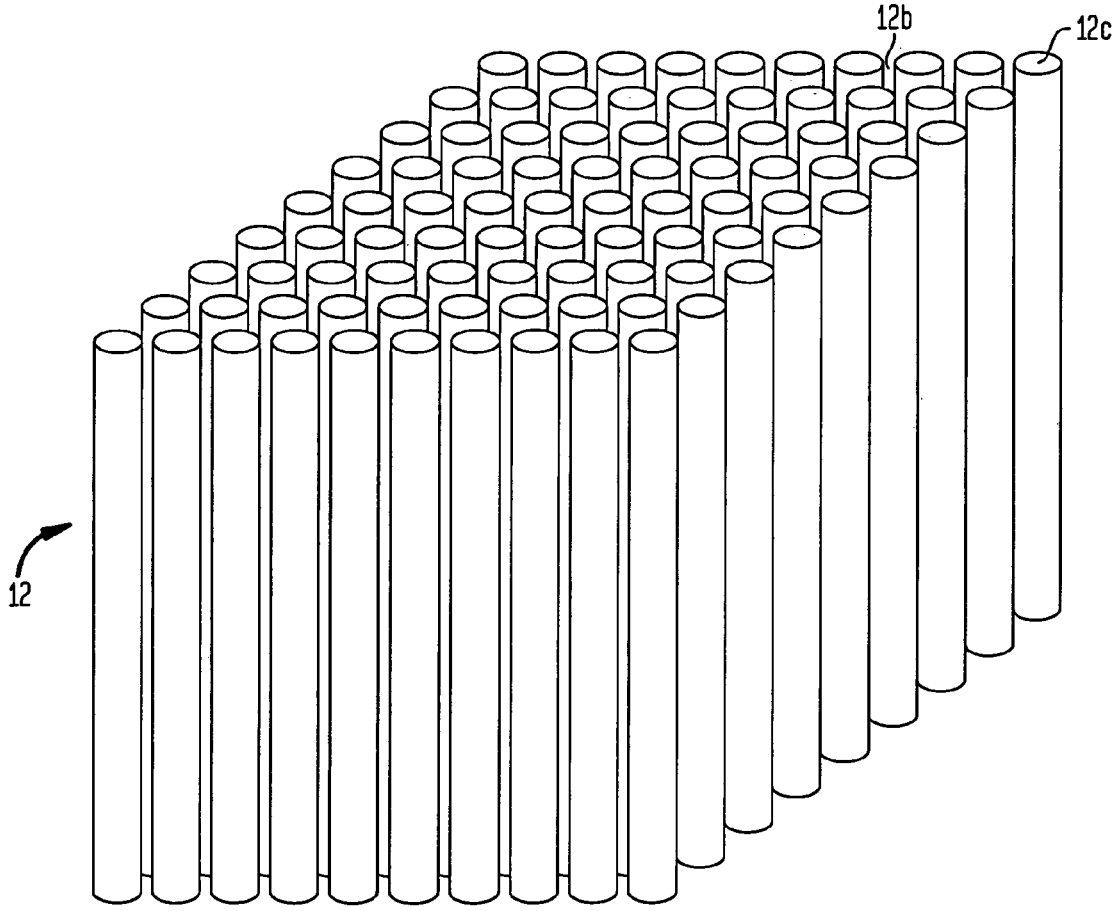
FIG. 2 shows a cross-sectional view of an inverse collimator of the inverse collimator detector of FIG. 1.

As illustrated in FIG. 2, rods or poles 12*c* can be inserted into the collimation holes 12*a* of the inverse collimator 12. In the preferred embodiment, lead rods or poles are inserted into the collimation holes 12*a*. It will be appreciated by those skilled in the art that the collimation holes 12*a* can be filled with other suitable dense material such as tungsten, copper-beryllium, brass, etc. The rods 12*c* can have a circular, square, hexagonal, oval or other cross-sectional shape that is compatible with the collimation holes 12*a*, in addition to varying lengths.

Septal penetration star artifact is produced when a source of radioactivity is particularly intense and the energy of the radiation is high. Generally, the "star" consists of a center and six legs (e.g., a hexagonal array collimator) corresponding to septal penetration. The legs have a significantly lower intensity than the center since they are formed through the attenuating lead. Data is used from the legs to enhance the raw acquired image.

In the present invention, photons create intense star artifacts rather than faint ones. The high count sensitivity allows for sufficient statistics to be accumulated such that shape-dependent deconvolution of the star artifact can be performed. For example, a wide star artifact implies that the source is very close to the collimator surface, and a very narrow star artifact implies that the source is farther away from the collimator surface. The additional counting statistics provide an accurate determination of the star centroid, thereby giving a high degree of spatial resolution in a manner similar to, for example, Anger logic in a gamma camera.

The length of the rods 12*c* determine the sensitivity of the inverse collimator 12. For example, the longer the rods 12*c*, the lower the sensitivity and the narrower the star response. Accordingly, there will be less overlap of data. The shorter the rods 12*c*, the wider the star response, and there will be more overlap of data. The rods 12*c* do not have to be in perfect alignment, thereby limiting the size of the star artifact by the offset of the pattern.

The pitch 12*b* of the rods 12*c* can be in the order of the intrinsic resolution of the camera. For example, if the pitch of the rods 12*c* is too big, then there will be too many pixels involved to give pixel-sized resolution. If the pitch of the rods 12*c* is too small, then there will be no sensitivity advantage or, alternatively, there will be penetration through the rods 12*c*.

Figure 3A:
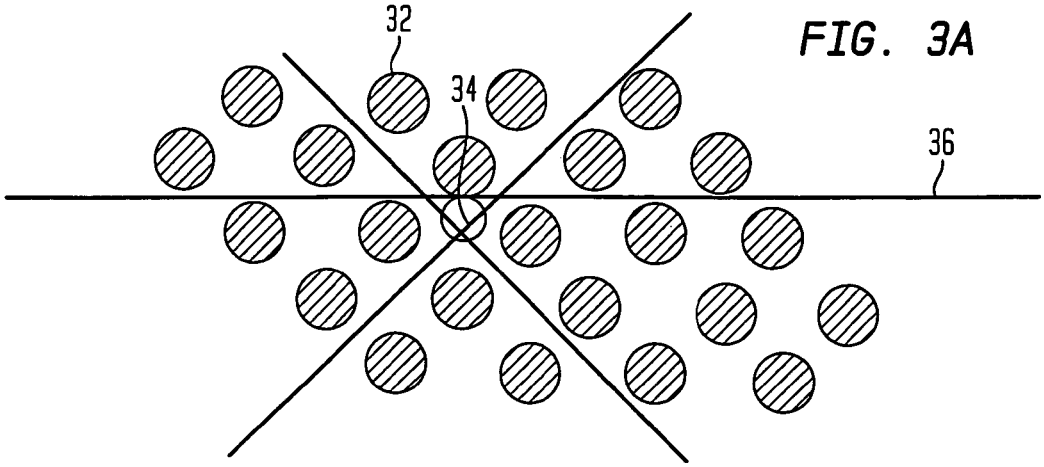
FIG. 3A is a schematic diagram of the inverse collimator illustrated in FIG. 1.
Figure 3B:
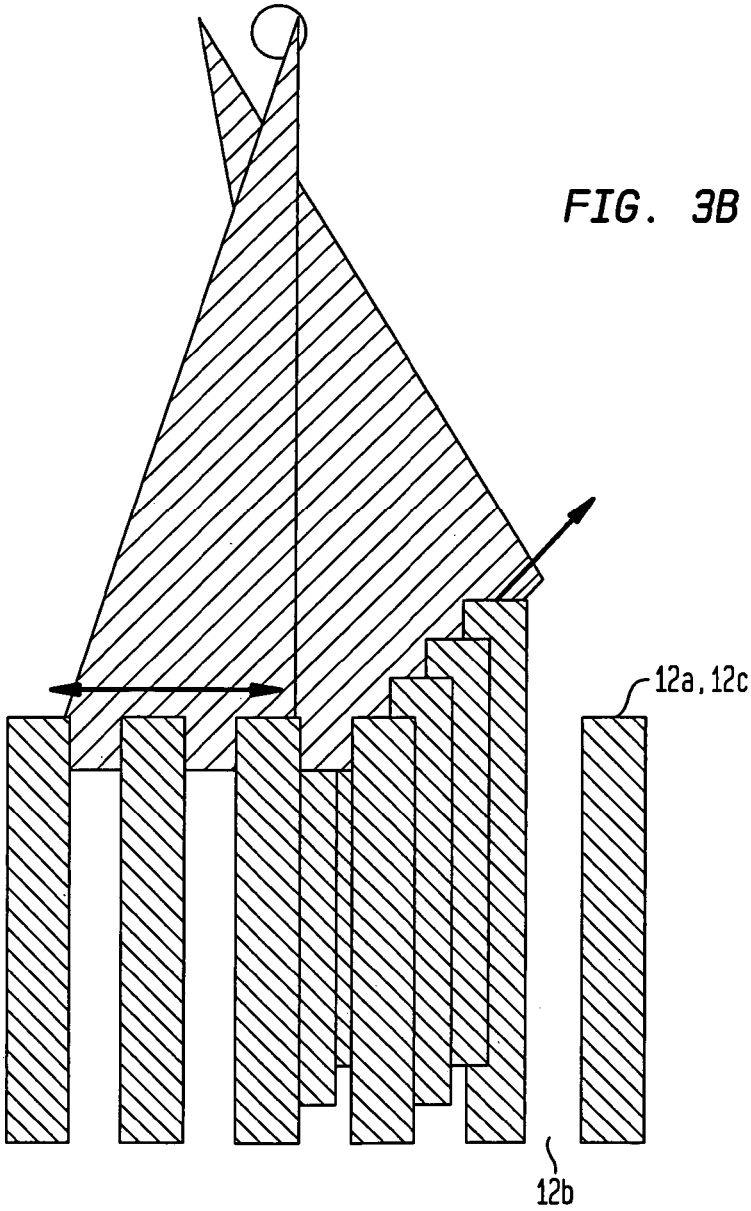
FIG. 3B is a schematic diagram of the inverse collimator illustrated in FIG. 2.

FIG. 3A is a schematic diagram of the inverse collimator 12 illustrated in FIG. 1, and FIG. 3B is a schematic diagram of the inverse collimator rods 12*c* illustrated in FIG. 2. Referring to FIG. 3A, the solid circles 32 represent the rods 12*c*, which are inserted into holes 12*a* as shown in FIG. 1; the open circle 34 represents a path for the perpendicular photons to enter the inverse collimator detector 10, and the lines 36 represent the 6-pointed star artifact. The slope of the star arms determines the distance from the inverse collimator 12 to the organs, bones or tissues of interest. The openings or spaces 12*b* between rods 12*c* of the inverse collimator 12 provide a path for photons (except for those that are perpendicular and hit the collimator septa) only moving perpendicular to the scintillator 14, as illustrated in FIG. 3B. In other words, photons traveling in all directions except those almost perpendicular to the surface of the detector are eliminated. The energy of the emitted photons as well as their location of origin are accumulated until a satisfactory image is obtained.

Figure 6:
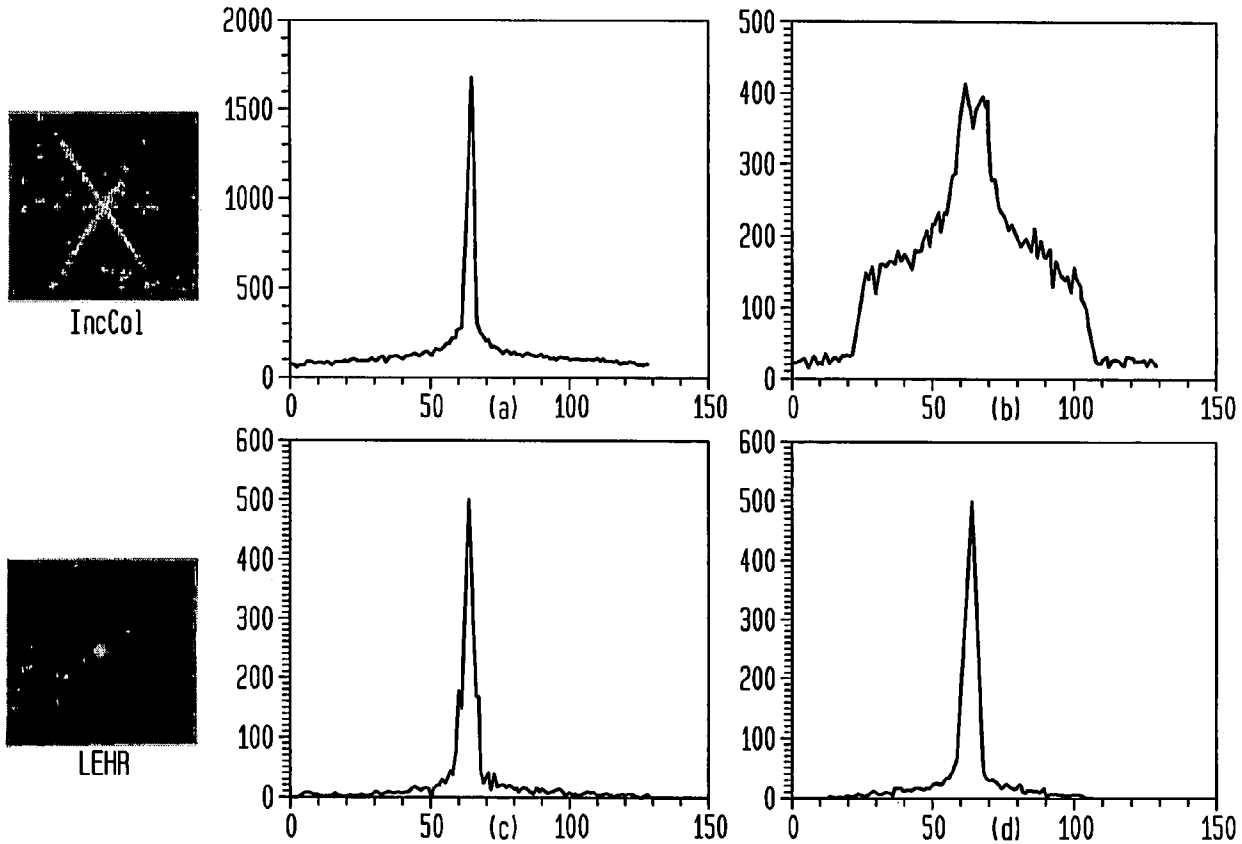
FIGS. 6(*a*)-(*d*) are graphs illustrating the improvement in sensitivity and spatial resolution using the inverse collimator detector according to an exemplary embodiment of the present invention.

FIGS. 6(*a*)-(*d*) are graphs illustrating the improvement in the sensitivity and spatial resolution using the inverse collimator detector 10 of the present invention. Referring to FIG. 6(*d*), there is an improvement by a factor of 4.8 in the sensitivity and spatial resolution.

The inverse collimator of the present invention improves sensitivity over conventional collimation in nuclear medicine by allowing more photons to be detected by the detector, and allowing more of the functioning pixels (detection elements) of the detector to contribute their imaging formation capability. Spatial resolution is maintained and enhanced by computer algorithms that deconvolve the characteristic response of the inverse collimator from raw images. Further, source-to-collimator distance information is available through image processing.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that the invention may be practiced otherwise than as specifically described herein.

What is claimed is:

1. An inverse collimator detector for detecting isolated sources of radiation, comprising:

a scintillator that interacts with radiation emanating from a target object being imaged;

an inverse collimator having a plurality of separated collimation holes filled with collimation rods, said inverse collimator being provided between the target object and said scintillator such that radiation from said object impinges on said scintillator through spaces between said collimation rods; and one or more photosensors optically coupled to said scintillator to receive interaction events from said scintillator.

2. The inverse collimator detector of claim 1, wherein said collimation rods are lead rods.

3. The inverse collimator detector of claim 1, wherein said collimation rods are at least one of tungsten, copper-beryllium or brass rods.

4. The inverse collimator detector of claim 1, wherein said collimation holes have at least one of a circular, square, hexagonal or oval cross-sectional shape.

5. The inverse collimator detector of claim 1, wherein said collimation rods have at least one of a circular, square, hexagonal or oval cross-sectional shape.

6. The inverse collimator detector of claim 1, wherein said collimation holes are arranged in a square array.

7. The inverse collimator detector of claim 1, wherein said collimation holes are arranged in a hexagonal array.

8. The inverse collimator detector of claim 1, wherein said collimation rods are in the order of the intrinsic resolution of said detector.

9. The inverse collimator detector of claim 1, wherein said inverse collimator is a plastic container.

10. An inverse collimator, comprising:

an array of collimation holes providing a path for perpendicularly incident photons, said collimation holes having a predefined diameter and a predefined depth;

a plurality of collimation rods disposed within said collimation holes, said collimation rods having a diameter corresponding to the diameter of said collimation holes and a length corresponding to the depth of said collimation holes; and a plurality of openings formed between said collimation holes, wherein the length of said collimation rods determines the sensitivity of said inverse collimator.

* * * * *